United States Patent [19]

Roeckl

[11] 4,068,317

[45] Jan. 17, 1978

[54] GLOVE

[76] Inventor: Stefan Roeckl, Auf der Sonnenlang 8, 8021 Icking, Germany

[21] Appl. No.: 663,628

[22] Filed: Mar. 3, 1976

[51] Int. Cl.[2] ..... A41D 19/02

[52] U.S. Cl. ..... 2/169

[58] Field of Search ..... 2/161 R, 169, 159, 163, 2/167, 165, 166; 33/12

[56] References Cited

U.S. PATENT DOCUMENTS

| | | | |
|---|---|---|---|
| 1,861,601 | 6/1932 | Johanson | 2/169 |
| 2,226,604 | 12/1940 | Geissmann | 2/169 |
| 2,596,349 | 5/1952 | Thurlow et al. | 2/169 |
| 2,719,980 | 10/1955 | Haupt et al. | 2/159 |
| 3,251,067 | 5/1966 | Shmikler | 2/169 |
| 3,273,165 | 9/1966 | Sperandeo | 2/169 |
| 3,760,425 | 9/1973 | Komatsa | 2/169 |
| 3,822,417 | 7/1974 | Lars-Jos | 2/169 |

*Primary Examiner*—G. V. Larkin
*Attorney, Agent, or Firm*—C. Walter Mortenson

[57] ABSTRACT

The invention relates to a novel glove of the type in which the glove material for covering the palm of the hand is integral with the material for covering the index and small fingers, the glove material for covering the second and third fingers being cut separately. In the glove of the invention, panel sections integral with the bases of the stalls for the second and third fingers are provided for covering the back-hand side canted area of the crotch between adjacent fingers.

9 Claims, 9 Drawing Figures

26
24
12
14
16
32
22
20
18
30
28
34
76
72
64
60
10
36

GLOVE

This application is a continuation of my patent application filed on Sept. 4, 1974, and bearing Ser. No. 502,915. This parent application is now abandoned.

The invention relates to a glove of the type in which the glove material for covering the palm of the hand is cut integrally with material for forming stalls for the index and small fingers, glove material for covering the thumb, the second and third fingers and the back of the hand being cut separately.

The weakest parts of gloves are in the seams, which are particularly subject to wear and tear. This can be observed from used gloves, which normally show wear at the seams, or tearing or splitting at the seams. On the other hand, it is seldom that the material itself, employed for making the glove, such as leather, tears or wears through.

Obviously, seams situated in working areas of the gloves are most subject to wear. Gloves of known types all have a seam along at least one side, namely along the side for covering the outer side of the index finger and/or the outer side of the small finger. The sides of the glove, however, are regions which are subject to strong wear and tear or scraping against objects. Furthermore, in gloves in which the glove material panel for covering the palm is integral with glove material panels for covering the inner surfaces of the fingers, seams joining said panels for covering the inner surfaces of the fingers to side panels for covering the sides of the fingers need to be in the plane of the palm. Such seams invariably come into contact with an object to be handled and are thus subject to wear.

A situation similar to above is to be found in thumb stalls of many gloves. The working or gripping surface in most handling operations is between the inner side of the thumb and the index finger or inner side of the hand. Seams situated in this working surface are particularly subject to wear.

It is an object of the invention to provide a glove in which the length of seams is reduced to a minimum. A further object is to ensure that seams are as far as possible moved away from areas of the glove which are particularly subject to wear, such as the gripping areas. A further and no lesser object is to provide a form-fitting glove allowing freedom of movement of the hand in the glove.

In accordance with the invention, there is provided a hand glove comprising a first panel forming a covering for the palm, sides and lateral portions of the back of the hand and forming stalls for the index and small fingers, a second panel forming a stall for the thumb, secured about an opening for the thumb provided in said first panel, and a third panel secured to said first panel forming a covering for the central area of the back of the hand and forming stalls for the second and third fingers, said third panel including six panel sections integral with the bases of the stalls for the second and third fingers for fitting over the canted areas of the crotches between each of the fingers on the back-hand side of the hand, first and second of such panel sections being secured together between the second and third fingers, third and fourth of such panel sections being secured to the base of the stall for the index finger between the index finger and second fingers, and fifth and sixth of such panel sections being secured to the base of the stall for the small finger between the third and small fingers.

The third panel may be provided in two portions, the one portion forming a covering for the part of the central area of the back of the hand from which the second finger extends, and forming the stall for the second finger, and the other portion forming a covering for the part of the central area of the back of the hand from which the third finger extends and forming the stall for the third finger, the second, third and fourth of said panel sections then being integral with the base of the stall for the second finger, and the first, fifth and sixth of said panel sections being integral with the base of the stall for the third finger.

In a further construction of a hand glove in accordance with the invention, said third panel is provided in three portions, the first portion forming a covering for the inside and sides of the third finger, said first portion including said first, fifth and sixth panel sections, the second portion forming a covering for the inside and sides of the second finger, said second portion including said second, third and fourth panel sections, the third portion including a covering for the central area of the back of the hand and for the back-hand side of the third and second fingers, said first portion being secured to said third portion along one margin of the covering for the back-hand side of the third finger, said second portion being secured to said third portion along one margin of the covering for the back-hand side of the second finger.

In another construction of a hand glove in accordance with the invention, fork shaped panel sections covering the web between the fingers of the hand are provided between said third and fourth of said panel sections, and between said fifth and said sixth of said panel sections, respectively, to give the fingers a very good movability.

In a still further construction of a hand glove in accordance with the invention, the glove comprises a first panel forming a covering for the palm, sides and back of the hand and forming stalls for the index, second, third and small fingers, a second panel forming a stall for the thumb, secured about an opening for the thumb provided in said first panel, said first panel including six panel sections integral with the bases of the stalls for the second and third fingers for fitting over the canted area of the crotches between each of the fingers on the back-hand side of the hand, first and second of said panel sections being secured together between the second and third fingers, third and fourth of such panel sections being secured to the base of the stall for the index finger between the index finger and second finger, and fifth and sixth of such panel sections being secured to the base of the stall for the small finger between the third and small fingers.

In still another construction of a hand glove in accordance with the invention, said first panel is provided in three portions, the first portion forming a covering for the inside and sides of the third finger, said first portion including said first, fifth and sixth panel sections, the second portion forming a covering for the inside and sides of the second finger, said second portion including said second, third and fourth panel sections, the third portion including a covering for the palm, sides and back of the hand and for the back-hand sides of the third and second fingers and forming stalls for the index and small fingers, and partially for the third and second fingers, said first portion being secured to said third portion along one margin of the covering for the back-hand side of the second finger, said second portion being secured to said third portion along one margin of the covering for the back-hand side of the third finger.

In a further construction of a hand glove in accordance with the invention, the glove comprises a first panel forming a covering for the palm, sides and back of the hand and forming stalls for the index, second, third and small fingers, a second panel forming a stall for the thumb, secured about an opening for the thumb provided in said first panel, said first panel including six panel sections integral with the bases of the stalls for the second and third fingers for fitting over the canted area of the crotches between each of the fingers on the back-hand side of the hand, first and second of said panel sections being secured together between the second and third fingers, third and fourth of such panel sections being secured to the base of the stall for the index finger between the index finger and second finger, and fifth and sixth of such panel sections being secured to the base of the stall for the small finger between the third and small fingers, and wherein fork shaped panel sections are provided between said third and fourth of said panel sections, and between said fifth and said sixth of said panel sections, respectively, to give the fingers a very good movability.

In a still further construction of a hand glove in accordance with the invention, said second panel forming a stall for the thumb comprises only one longitudinal seam on the back-hand side of the thumb, said seam being provided by two outer edges of said second panel, which are secured together.

The glove fits exceptionally well, is easily movable, and seams are no longer present in the gripping areas of the fingers and the thumb. In the combination of some improvements, the new glove has a total seam length of 132 cm as against 152 cm in the glove called "Amercian working glove" and 198 cm in a conventional single piece cut glove or 222 cm when such is cut in two pieces. In the total area of the glove which is subject to wear, the new glove has a seam length of only 9 cm as against 47 cm in the glove called "American working glove" and 74 cm and 89 cm in a one piece of two piece cut glove of conventional cut. The new glove consists of only three individual portions as against four in a glove called the "American working glove" and eight and nine portions in a one piece or two piece glove of conventional cut. Correspondingly, the new glove involves three production steps as against four production steps in the case of the glove called "American working glove" and five production steps in the case of usual conventional gloves. In spite of this, the cut of the new glove is elegant and of attractive appearance.

Further features of gloves in accordance with the invention will become apparent from the following description with reference to the accompanying drawings.

Figure 1:
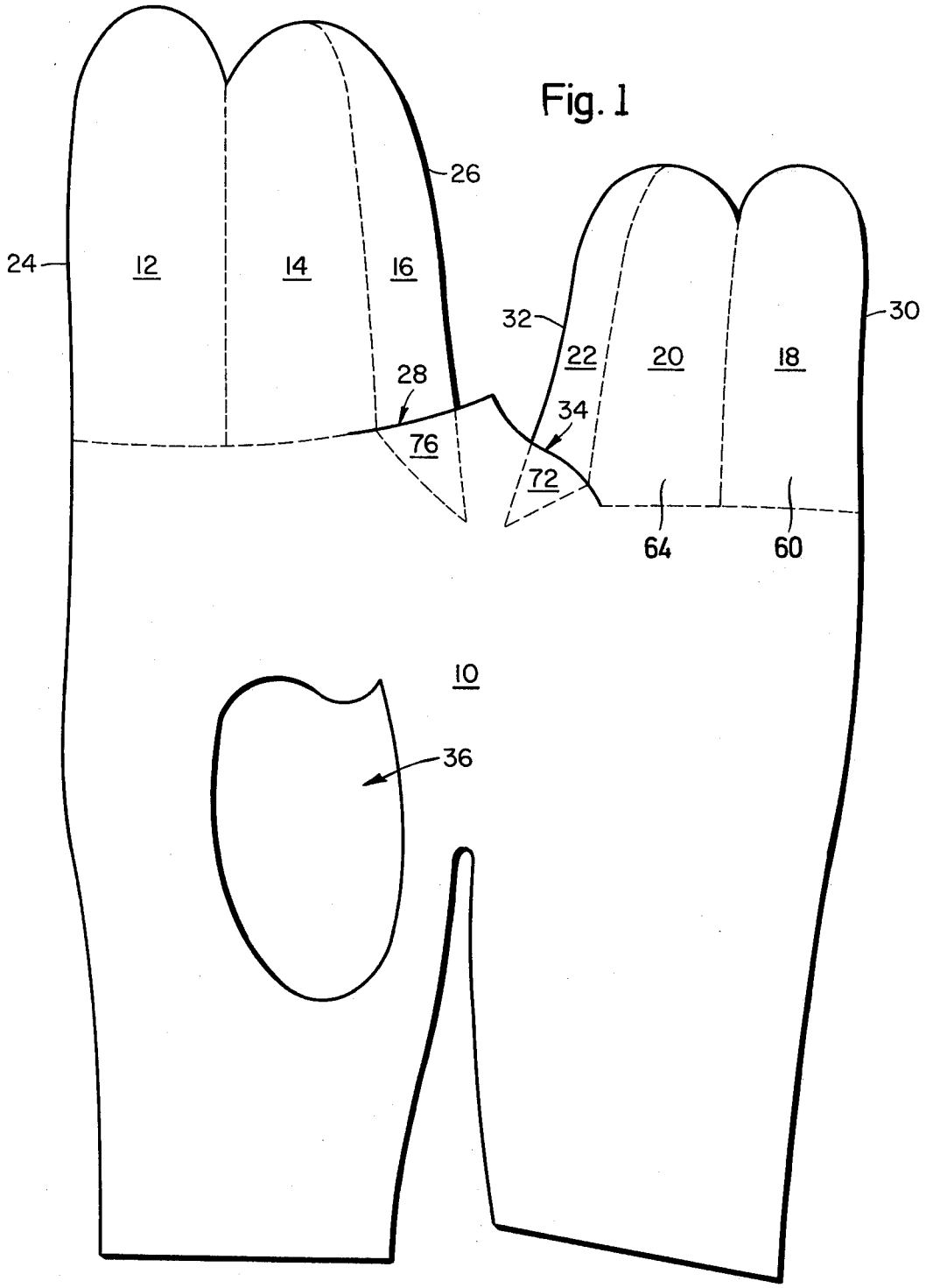
FIG. 1 shows a blank of a first panel for forming a covering for the palm, sides and lateral portions of the back of the hand and for forming stalls for the index and small fingers.

Referring to FIG. 1 of the drawings, the blank shown forms a covering 10 for covering the palm, sides and lateral portion of the back of the hand and cover sections 12, 14 and 16 for forming the stall for the index finger and cover sections 18, 20 and 22 for forming the stall for the small finger. In forming the stall for the index finger, edges 24 and 26 are brought together by folding backwardly out of the plane of the blank shown in FIG. 1. The cover section 16 and part of the cover section 14 are separated from the covering 10 for the palm by slit 28, which slit results in a margin being exposed at the base of the stall for the index finger. In the finished glove, this margin is situated between the stalls for the index and second fingers. Similarly, edges 30 and 32 are brought together by folding backwardly out of the plane of the blank shown in FIG. 1. The cover section 22 and part of the cover section 20 are separated from the covering 10 for the palm by slit 34, which slit results in a margin being exposed at the base of the stall for the small finger. In the finished glove, this margin is situated between the stalls for the third and small fingers.

An opening 36 for the thumb is provided in the blank shown in FIG. 1. Sections 72 and 76 marked in dashed lines will be explained hereinafter (see the discussion of FIG. 3).

Figure 2:
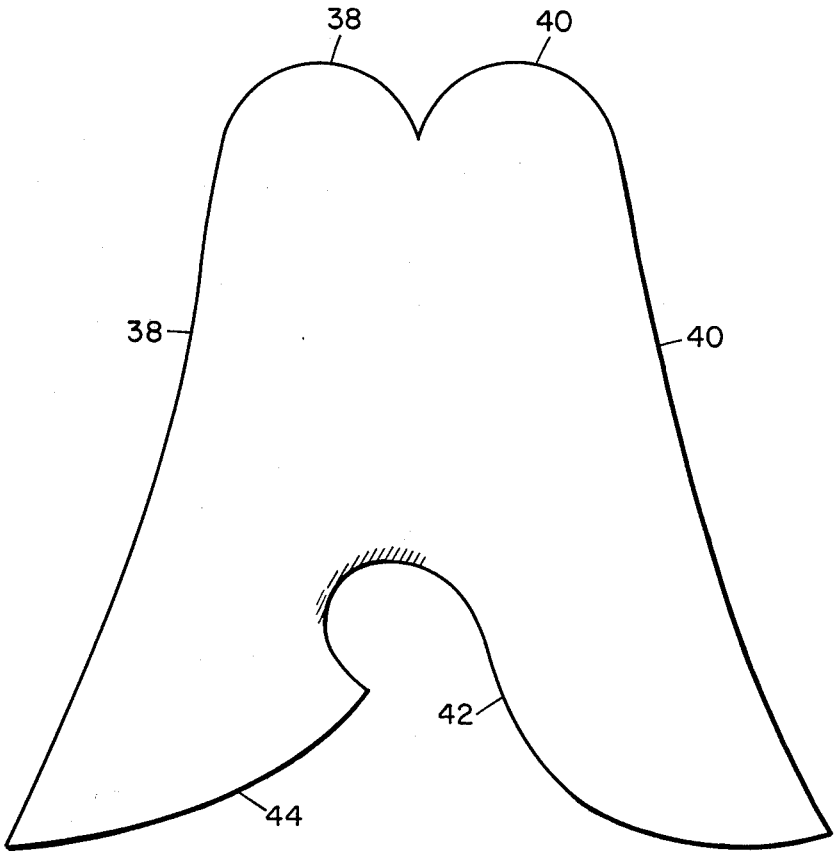
FIG. 2 shows a blank of a second panel for forming a stall for the thumb.

Referring now to FIG. 2 of the drawings, the blank shown is for forming a stall for the thumb. As will be apparent, edges 38 and 40 are brought together by folding backwardly out of the plane of the blank. There is only one longitudinal seam formed by edges 38 and 40 to make up the stall for the thumb. This single seam is arranged on the back-hand side or the outer side of the thumb, so that the whole gripping area of the thumb is free from seams. Edges 42 and 44 then define an opening into which a thumb may be inserted. The form and size of this opening correspond to the form and size of the opening 36 provided for the thumb in the blank shown in FIG. 1.

Figure 3:
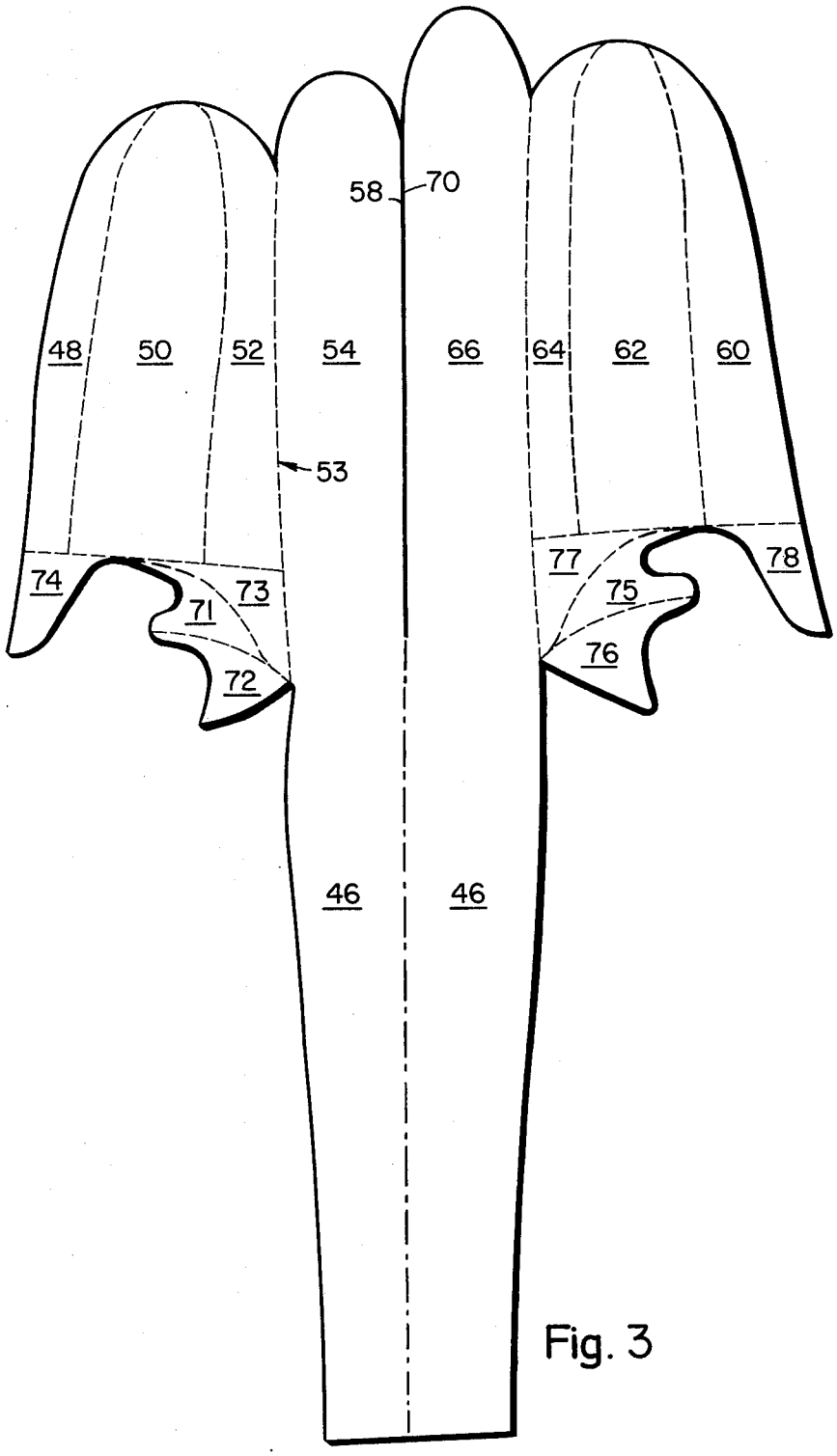
FIG. 3 shows a blank of a third panel for forming a covering for the central area of the back of the hand and for forming stalls for the second and third fingers.

Referring to FIG. 3, showing a blank of a third panel, cover sections 46 are provided for forming a covering for the central area of the back of the hand. Cover sections 48, 50, 52 and 54 are for forming the stall for the third finger. In forming the stall for the third finger, edges 56 and 58 are brought together by folding backwardly out of the plane of the blank shown in FIG. 3. Similarly, cover sections 60, 62, 64 and 66 are for forming the stall for the second finger. In forming the stall for the second finger, edges 68 and 70 are brought together by folding backwardly out of the plane of the blank.

Still referring to FIG. 3, panel sections 72 and 74 are provided integrally with the base of the stall for the third finger formed by cover sections 48, 50, 52 and 54. As may be seen from FIG. 1, the panel sections 72 and 76 cannot be formed integrally with the cover sections 22 and 16, respectively, because this would result in cut out portions in covering 10. As will be more readily understood with reference to FIG. 4, panel section 72 is provided for fitting over the canted area of the crotch between the third and small fingers, and panel section 74 is provided for fitting over one half of the canted area of the crotch between the second and third fingers. Similarly, panel sections 76 and 78 are provided integrally with the base of the stall for the second finger formed by cover sections 60, 62, 64 and 66. As will again be more readily understood with reference to FIG. 4, panel section 76 is provided for fitting over the canted area of the crotch between the index and second fingers, and panel section 78 is provided for fitting over the other half of the canted area of the crotch between the second and third fingers. Thus, panel sections 74 and 78 together form a covering for the canted area of the crotch between the second and third fingers.

As will be readily understood with reference to FIG. 3, panel sections 72 and 76 belong strictly speaking to the cover sections 22 and 16, respectively, for the sides of the index finger and the small finger, respectively. Similarly, there are also panel sections 73 and 77 which belong to the cover sections 52 and 64, respectively, for the sides of the third finger and the second finger, respectively. In the blank of the third panel shown in FIG. 3, it is readily understood that there is room for all these panel sections 72, 76, 73, 77 without the necessity of a cut out portion in the blank.

Preferably in the blank of the third panel shown in FIG. 3, the panel sections 72, 76, 73, 77 are integral with each other and with the remainder of the panel. They may, of course, also be separated from each other along the dashed lines and may be sewn together to form the stalls for the respective fingers.

In accordance with a further form a glove of the invention, for the movability of the index finger stall relative to the second finger stall, and of the small finger stall relative to the third finger stall, fork shaped panel sections 71 and 75 are provided between panel sections 72 and 73, and between panel sections 76 and 77 respectively. The movability of the finger stalls is thus improved, in that more room is left for movement of the fingers at their bases.

The fork shaped panel sections 71 and 75 can again be integral with panel sections 72 and 73 or 76 and 77, respectively, or they may be separated from said panel sections.

Figure 4:
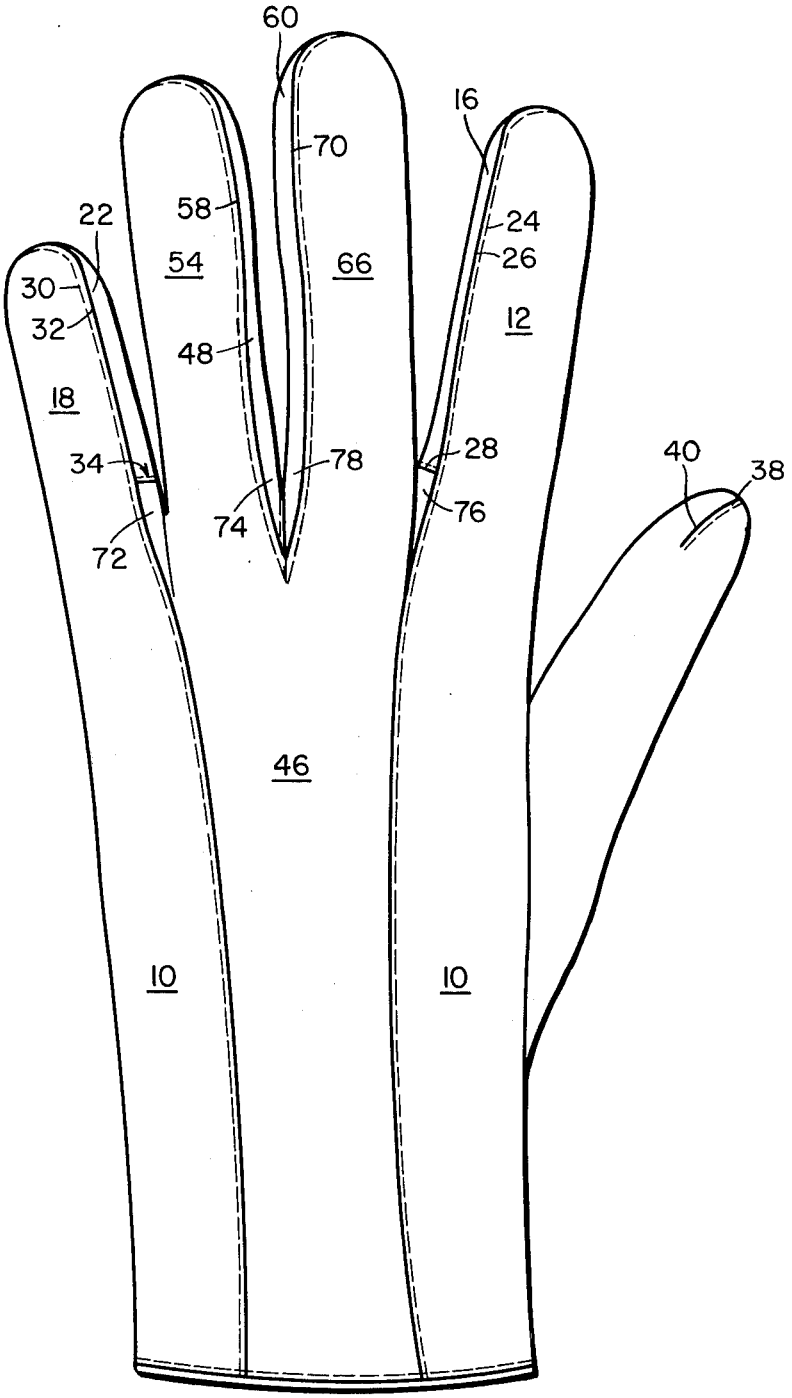
FIG. 4 shows a hand glove made up of the blanks shown in FIGS. 1, 2 and 3.

In FIG. 4, showing a hand glove made up of the blanks shown in FIGS. 1, 2 and 3, reference numerals are consistent with reference numerals employed in said FIGS. 1, 2 and 3.

Figure 5:
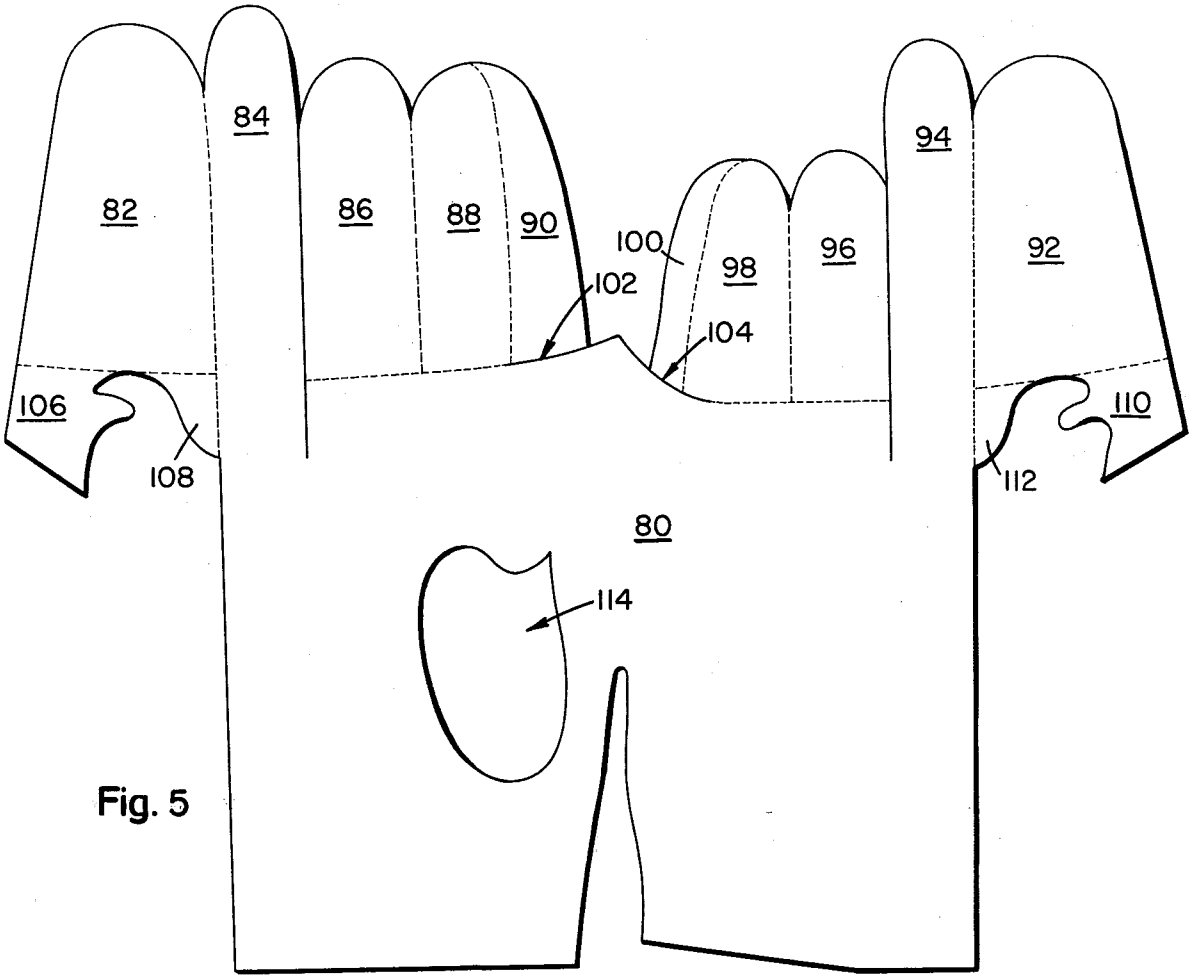
FIG. 5 shows a blank of a first panel for forming a covering for the palm, sides, and back of the hand and for forming stalls for the index, second, third, and small fingers.

Referring now to FIG. 5 of the drawings, reference numeral 80 refers to a cover section for covering the palm side, sides and entire back-hand side of the hand. Cover sections 82 and 84 at the left-hand side of FIG. 5 are for forming the stall for the second finger, and the adjoining cover sections 86, 88 and 90 are for forming the stall for the index finger. Similarly, cover sections 92 and 94 at the right-hand side of FIG. 5 are for forming the stall for the third finger, and adjoining cover sections 96, 98, and 100 are for forming the stall for the small finger. In a manner similar to that described in relation to FIG. 1, slit 102 separating cover section 90 and part of cover section 88 from the cover section 80 results in a margin being exposed at the base of the stall for the index finger. In the same way, slit 104 separating cover section 100 and part of cover section 98 from the cover section 80 results in a margin being exposed at the base of the stall for the small finger.

Panel sections 106 and 108 are provided integrally with the base of the stall for the second finger formed by cover sections 82 and 84, and panel sections 110 and 112 are provided integrally with the base of the stall for the third finger formed by cover sections 92 and 94. As will be appreciated from the shape of panel sections 106, 108, 110 and 112, which are similar to but reverse of corresponding panel sections 76 and 78 in FIG. 3, panel section 106 is provided for fitting over the canted area of the crotch between the index and second fingers, and panel section 108 is provided for fitting over one half of the canted area of the crotch between the second and third fingers. In the same manner, panel section 110 is provided for fitting over the canted area of the crotch between the third and small fingers, and panel section 112 is provided for fitting over the other half of the canted area of the crotch between the second and third fingers.

As in FIG. 1, an opening 114 for the thumb is provided in the blank shown in FIG. 5.

Figure 6:
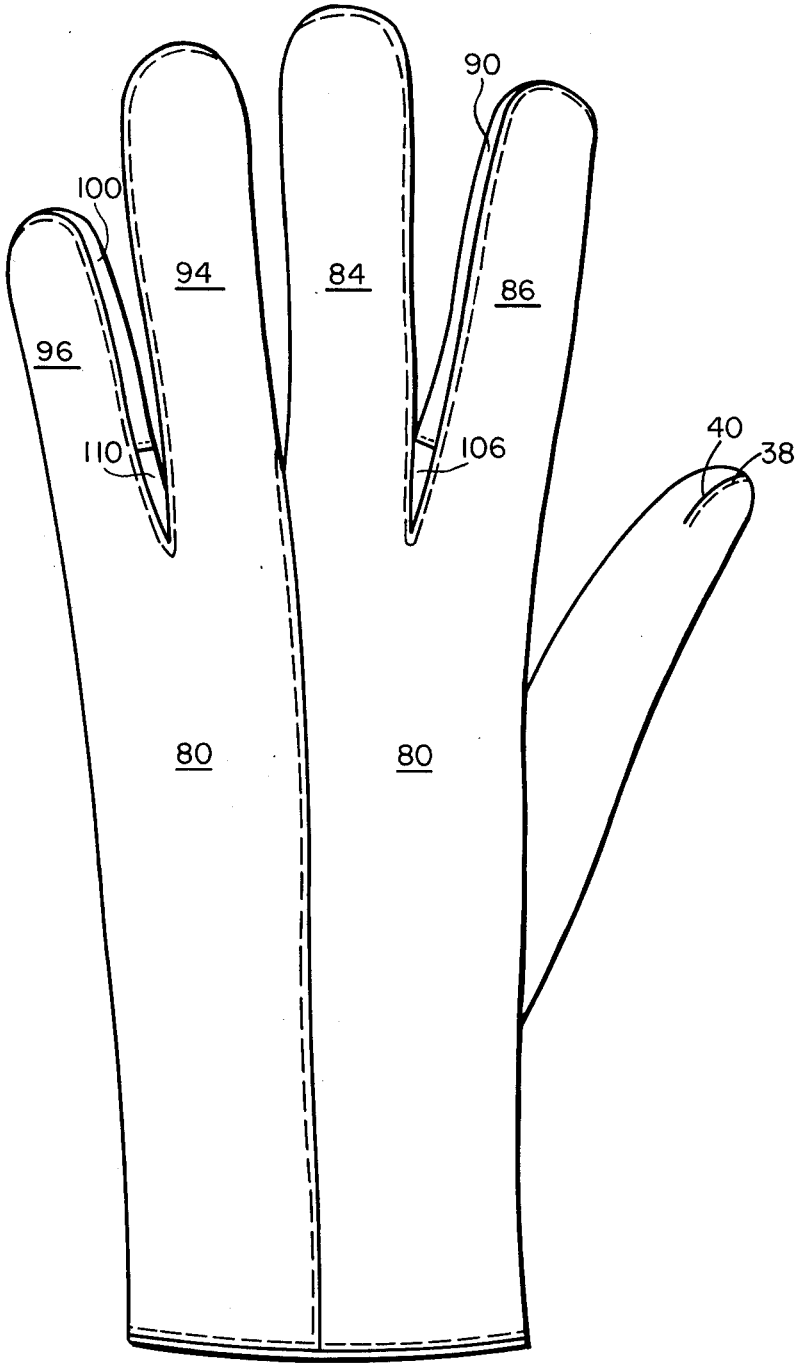
FIG. 6 shows a hand glove made up of the blank shown in FIGS. 5 and 2.

In FIG. 6, showing a hand glove made up of the blanks shown in FIGS. 2 and 5, reference numerals are consistent with reference numerals employed in said FIGS. 2 and 5.

Figure 7:
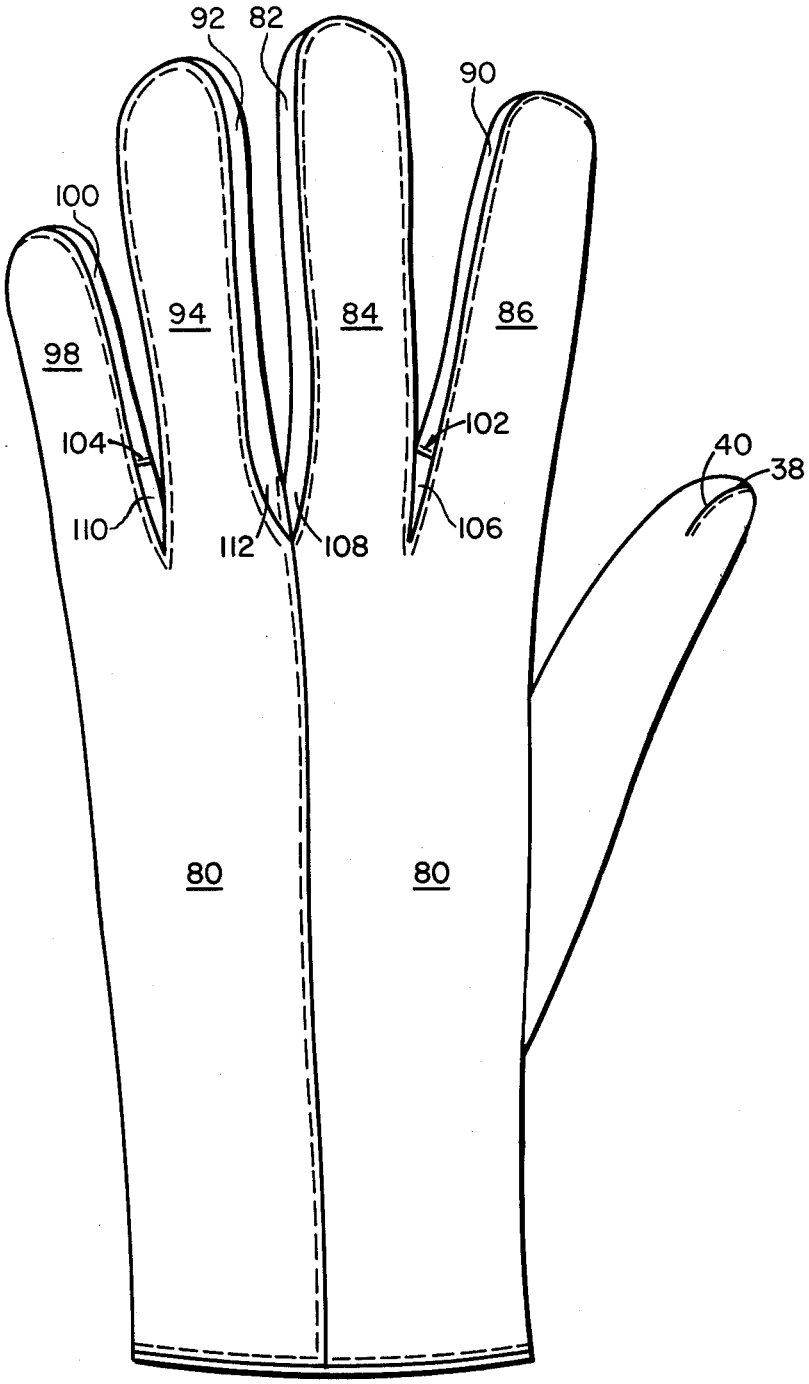
FIG. 7 shows a hand glove similar to the glove of FIG. 6, but where the cover sections which form the inside and sides of the second finger and of the index finger are not integral with the blank of FIG. 3.

In FIG. 7, there is shown a hand glove made up of the blank of FIG. 2 and a blank similar to that of FIG. 5, but wherein the cover sections 82 and 92, which form the inside and sides of the second finger and of the index finger, respectively, are separated and not integral with the cover sections 84 and 94, respectively. Again, reference numerals of FIGS. 2, 5 and 7 are consistent with each other.

Figure 8:
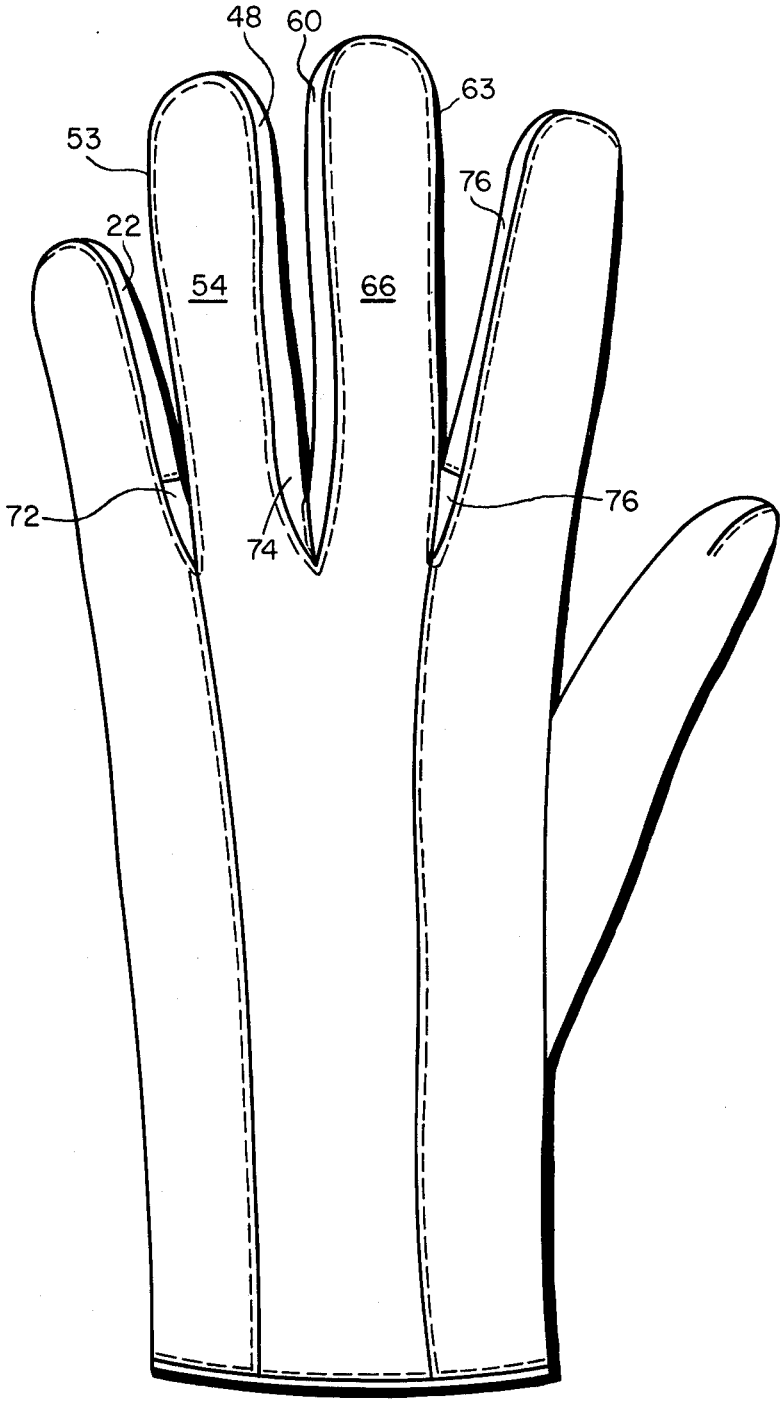
FIG. 8 shows a hand glove similar to the glove of FIG. 4, but where also the cover sections which form the back-hand sides of the second finger and of the index finger are not integral with the blank of FIG. 3 but separated therefrom.

In FIG. 8, there is shown a hand glove made up of the blanks of FIGS. 1 and 2 and a blank substantially the same as in FIG. 3, but referring to FIG 3, wherein the cover section 52 for covering one side of the third finger, and panel section 73 are separated from cover section 54, line 53 being cut through, and wherein the cover section 64 for covering one side of the index finger, and panel section 77, are separated from cover section 66, line 63 being cut through. Again, reference numerals of FIGS. 2, 3 and 8 are consistent with each other.

Figure 9:
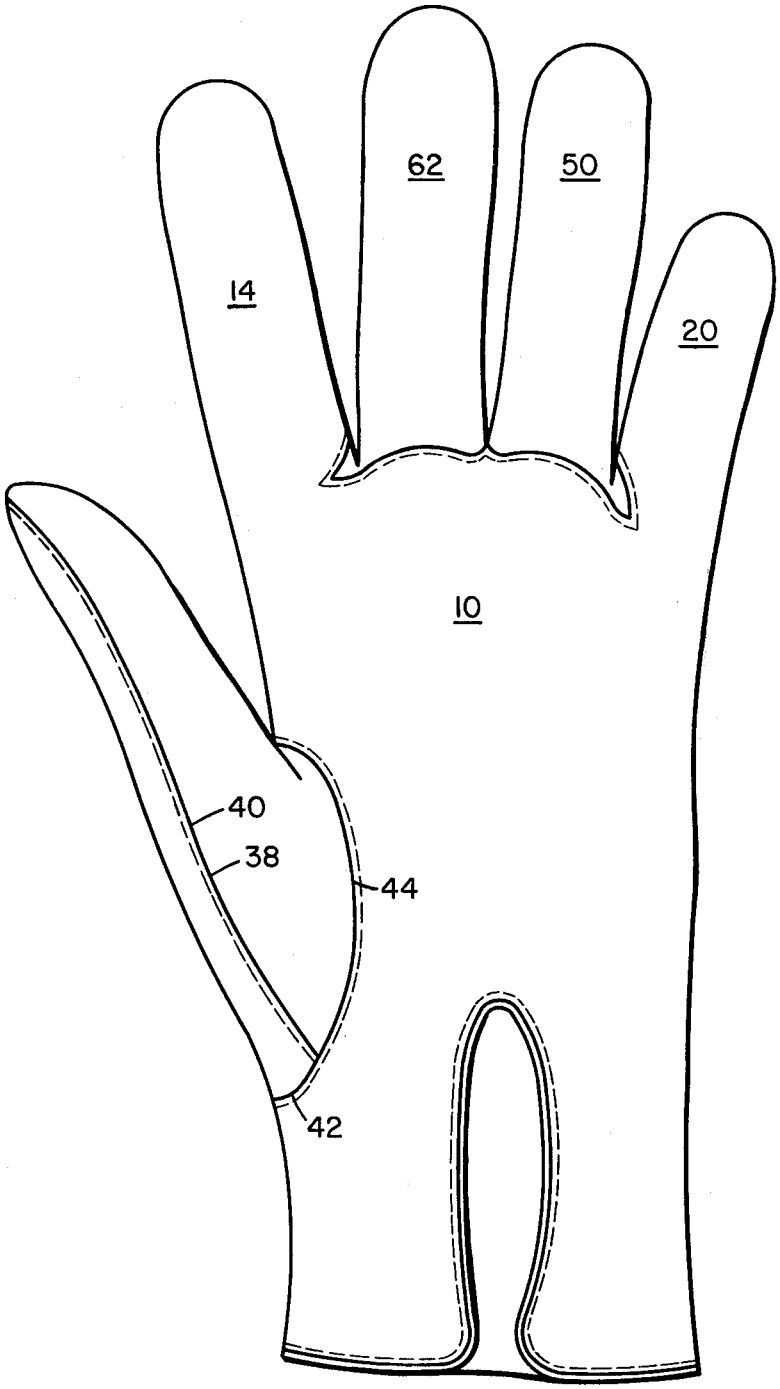
FIG. 9 shows the palm side of the hand glove of both of FIGS. 4 and 6.

In FIG. 9, showing the palm side of the hand glove of FIGS. 4, 6, 7 and 8, reference numerals are consistent with the reference numerals employed in FIGS. 1 to 3.

What is claimed is:

1. A hand glove comprising a first panel forming a covering for the palm, sides and lateral portions of the back of the hand and forming stalls for the index and small fingers, a second panel forming a stall for the thumb, secured about an opening for the thumb provided in said first panel, and a third panel secured to said first panel forming a covering for the central area of the back of the hand and forming stalls for the second and third fingers, said third panel including six panel sections integral with the bases of the stalls for the second and third fingers for fitting over the canted areas of the crotches between each of the fingers on the back-hand side of the hand, first and second of such panel sections being secured together between the second and third fingers, third and fourth of such panel sections being secured to the base of the stall for the index finger between the index finger and second finger, and fifth and sixth such panel sections being secured to the base of the stall for the small finger between the third and small fingers.

2. A hand glove according to claim 1, in which said third panel is provided in two portions, the one portion forming a covering for the part of the central area of the back of the hand from which the second finger extends, and forming the stall for the second finger, and the other portion forming a covering for the part of the central area of the back of the hand from which the third finger extends and forming the stall for the third finger, the second, third and fourth of said panel sections then being integral with the base of the stall for the second finger, and the first, fifth and sixth of said panel sections being integral with the base of the stall for the third finger.

3. A hand glove according to claim 1, in which said third panel is provided in three portions, the first portion forming a covering for the inside and sides of the third finger, said first portion including said first, fifth and sixth panel sections, the second portion forming a covering for the inside and sides of the second finger, said second portion including said second, third and fourth panel sections, the third portion including a covering for the central area of the back of the hand and for the back-hand side of the third and second fingers, said first portion being secured to said third portion along one margin of the covering for the back-hand side of the third finger, said second portion being secured to said third portion along one margin of the covering for the back-hand side of the second finger.

4. A hand glove according to claim 1, in which fork shaped panel sections are provided between said third and fourth of said panel sections, and between said fifth and sixth of said panel sections, respectively, to improve mobility of the finger stalls.

5. A hand glove comprising a first panel forming a covering for the palm, sides and back of the hand and forming stalls for the index, second, third and small fingers, a second panel forming a stall for the thumb, secured about an opening for the thumb provided in said first panel, said first panel including six panel sections integral with the bases of the stalls for the second and third fingers for fitting over the canted areas of the crotches between each of the fingers on the back-hand side of the hand, first and second of said panel sections being secured together between the second and third fingers, third and fourth of such panel sections being secured to the base of the stall for the index finger between the index finger and second finger, and fifth and sixth of such panel sections being secured to the base of the stall for the small finger between the third and small fingers.

6. A hand glove according to claim 5, in which said first panel is provided in three portions, the first portion forming a covering for the inside and sides of the third finger, said first portion including said first, fifth and sixth panel sections, the second portion forming a covering for the inside and sides of the second finger, said second portion including said second, third and fourth panel sections, the third portion including a covering for the palm, sides and back of the hand and for the back-hand sides of the third and second fingers and forming stalls for the index and small fingers, and partially for the third and second fingers, said first portion being secured to said third portion along one margin of the covering for the back-hand side of the second finger, and said second portion being secured to said third portion along one margin of the covering for the back-hand side of the third finger.

7. A hand glove according to claim 5, in which fork shaped panel sections are provided between said third and fourth of said panel sections, and between said fifth and sixth of said panel sections, respectively, to improve the mobility of the finger stalls.

8. A hand glove according to claim 5, in which said second panel forming a stall for the thumb comprises only one longitudinal seam on the back-hand side of the thumb, said seam being provided by two outer edges of said second panel which are secured together.

9. A hand glove according to claim 1, in which said second panel forming a stall for the thumb comprises only one longitudinal seam on the back-hand side of the thumb, said seam being provided by two outer edges of said second panel, which are secured together.

* * * * *